US011677184B2

(12) United States Patent
Yamane et al.

(10) Patent No.: US 11,677,184 B2
(45) Date of Patent: Jun. 13, 2023

(54) CONNECTOR AND CONNECTOR ASSEMBLY

(71) Applicants: Tyco Electronics Japan G.K., Kawasaki (JP); TOYOTA JIDOSHA KABUSHIKI KAISHA, Toyota (JP)

(72) Inventors: Tomokazu Yamane, Kasawaski (JP); Seiji Komatsu, Kawasaki (JP); Ryutaro Tokitsu, Toyota (JP); Kensuke Matsuo, Toyota (JP)

(73) Assignees: Tyco Electronics Japan G.K., Kawasaki (JP); Toyota Jidosha Kabushiki Kaisha, Toyota (JP)

( * ) Notice: Subject to any disclaimer, the term of this patent is extended or adjusted under 35 U.S.C. 154(b) by 62 days.

(21) Appl. No.: 17/336,572

(22) Filed: Jun. 2, 2021

(65) Prior Publication Data

US 2021/0384672 A1 Dec. 9, 2021

(30) Foreign Application Priority Data

Jun. 3, 2020 (JP) ..... JP2020-097183

(51) Int. Cl.
*H01R 13/629* (2006.01)
*H01R 13/64* (2006.01)

(52) U.S. Cl.
CPC ..... *H01R 13/62938* (2013.01); *H01R 13/64* (2013.01)

(58) Field of Classification Search
CPC ..... H01R 13/62933; H01R 13/62938; H01R 13/62955; H01R 13/62988; H01R 13/64
See application file for complete search history.

(56) References Cited

U.S. PATENT DOCUMENTS 5,252,084 A * 10/1993 Wakata ..... H01R 13/62955 439/157
5,474,461 A * 12/1995 Saito ..... H01R 13/62933 439/351
5,476,390 A * 12/1995 Taguchi ..... H01R 13/62938 439/157

(Continued)

FOREIGN PATENT DOCUMENTS

EP 2811586 A1 12/2014
JP 2002-343169 A 11/2002

OTHER PUBLICATIONS

Extended European Search Report, App No. 21175150.8, dated Oct. 27, 2021, 9 pages.

*Primary Examiner* — Thanh Tam T Le
(74) *Attorney, Agent, or Firm* — Barley Snyder

(57) ABSTRACT

A connector configured to be fitted with a mating connector includes a main housing, a sub-housing supported on the main housing to be slidable in a fitting direction with respect to the main housing in which the connector is fitted with the mating connector, and an operating member pivotably and slidably supported on the main housing. The main housing moves closer to the mating connector when the operating member is pivoted from a first posture to a second posture. The sub-housing moves in the fitting direction when the operating member slides from the second posture in a direction different from the fitting direction. The sub-housing has an erroneous fitting prevention part abutting against the mating connector in a state of incomplete fitting of the connector with the mating connector.

16 Claims, 11 Drawing Sheets

(56) References Cited

U.S. PATENT DOCUMENTS

| | | | | |
|---|---|---|---|---|
| 5,637,003 | A * | 6/1997 | Takahashi | H01R 13/62933 439/153 |
| 9,176,341 | B2 * | 11/2015 | Kuwayama | H05B 47/10 |
| 9,325,112 | B2 * | 4/2016 | Tabata | H01R 13/62966 |
| 9,484,668 | B2 * | 11/2016 | Kamei | H01R 13/62938 |
| 9,893,469 | B2 * | 2/2018 | Tabata | H01R 24/005 |
| 9,966,701 | B2 * | 5/2018 | Tabata | H01R 13/641 |
| 10,003,155 | B2 * | 6/2018 | Giefers | H01R 13/6275 |
| 10,163,590 | B2 * | 12/2018 | Tabata | H01R 13/701 |
| 2002/0173185 | A1 | 11/2002 | Fukushima et al. | |
| 2014/0364010 | A1 * | 12/2014 | Kuwahara | B60L 53/16 439/626 |

* cited by examiner

CONNECTOR AND CONNECTOR ASSEMBLY

CROSS-REFERENCE TO RELATED APPLICATION

This application claims the benefit of the filing date under 35 U.S.C. § 119(a)-(d) of Japanese Patent Application No. 2020-097183, filed on Jun. 3, 2020.

FIELD OF THE INVENTION

The disclosure relates to a connector and a connector assembly that relay current supplied from a power supply system.

BACKGROUND

In electric vehicles and hybrid vehicles, connector devices capable of passing large current of, for example, 100 amperes are used. In situations such as maintenance, it may be necessary to separate (two) fitted connectors in this connector device. In that case, it is necessary to stop the flow of the flowing current and then separate the connectors in order to avoid electric shock. Therefore, a mechanism for reliably stopping the flow of current before separating the fitted connectors is required.

JP-A-2002-343169 discloses a connector device including a lever that fits two connectors by pivoting or releases the fitted state of the connectors by pivoting in the opposite direction. This connector device includes a main contact for passing large current and a sub-contact for detecting the fitting or separation of the connectors. Further, the lever has a structure that slides as well as pivots in a state where the connectors are fitted to each other. The lever pivots to connect the main contact, and then slides to connect the sub-contact. The fitting of the connectors is detected by the connection of the sub-contact, and large current then flows through the main contact. When releasing the fitting, first, the lever is slid. This releases the connection of the sub-contact, which cuts off the large current. Thereafter, the connectors are separated by pivoting the lever. With this structure, the connectors are separated from each other after the large current is reliably cut off.

In the connector device provided with the main contact and the sub-contact of JP-A-2002-343169, it is necessary to reliably perform an operation of connecting the main contact by the pivot operation of the lever and then connecting the sub-contact by the slide operation. Here, in the connector device including the main contact and the sub-contact, it is necessary to make the main contact and the sub-contact move independently. Therefore, depending on the structure of the connector device, some mistake or careless force may act, causing an issue that the sub-contact is connected and large current starts to flow before the connectors are completely fitted. Further, the slide operation may not be able to be performed after the pivot operation of the lever.

SUMMARY

A connector configured to be fitted with a mating connector includes a main housing, a sub-housing supported on the main housing to be slidable in a fitting direction with respect to the main housing in which the connector is fitted with the mating connector, and an operating member pivotably and slidably supported on the main housing. The main housing moves closer to the mating connector when the operating member is pivoted from a first posture to a second posture. The sub-housing moves in the fitting direction when the operating member slides from the second posture in a direction different from the fitting direction. The sub-housing has an erroneous fitting prevention part abutting against the mating connector in a state of incomplete fitting of the connector with the mating connector.

BRIEF DESCRIPTION OF DRAWINGS

The invention will now be described by way of example with reference to the accompanying Figures, of which.

DETAILED DESCRIPTION OF THE EMBODIMENT(S)

Figure 1:
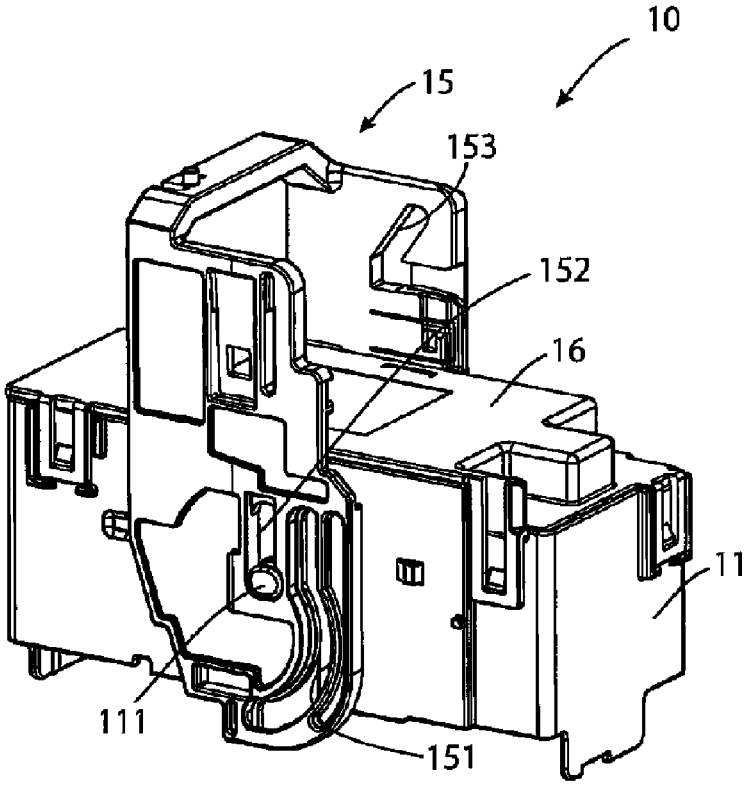
FIG. 1 is a perspective view of a first connector.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art. Furthermore, several aspects of the embodiments may form—individually or in different combinations—solutions according to the present invention. The following described embodiments thus can be considered either alone or in an arbitrary combination thereof.

Figure 2:
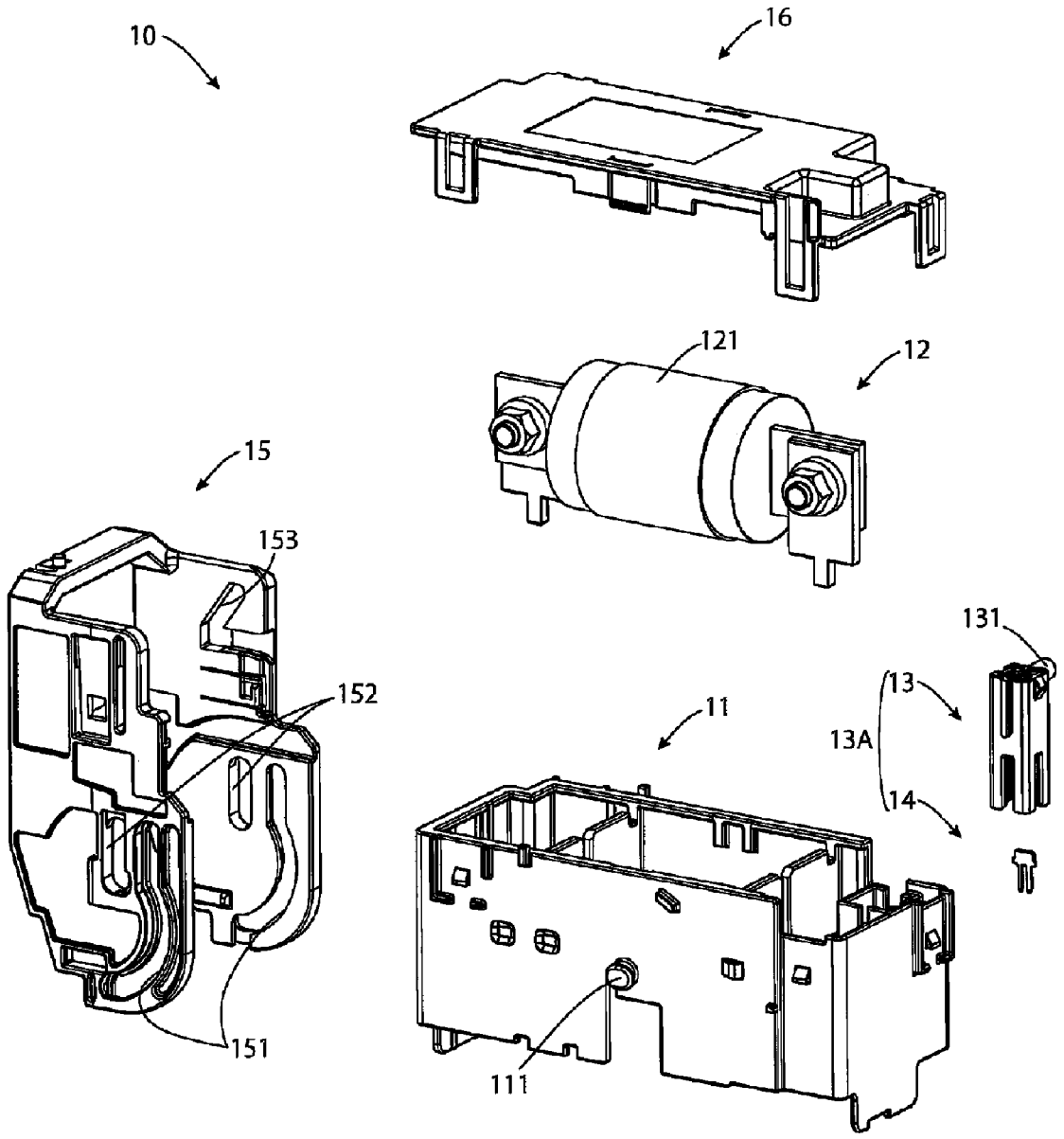
FIG. 2 is an exploded perspective view of the first connector.

The first connector 10, shown in FIGS. 1 and 2, corresponds to an example of the connector of the disclosure and an example of the first connector constituting a connector assembly of the disclosure.

The first connector 10 includes a main housing 11 and a main contact 12, as shown in FIGS. 1 and 2. The main housing 11 may have an opening at least in a part thereof and may have a shape that is widely open in an upper and lower direction. Large current of, for example, 100 amperes flows through the main contact 12. The main contact 12 includes a fuse 121 for preventing an overcurrent exceeding the standard. The main contact 12 is provided in the main housing 11 and is arranged, stored, or fixed in the main housing 11 through the opening, for example. The main contact 12 corresponds to an example of the first main contact mentioned in the disclosure.

The first connector 10 includes a sub-housing 13 and a sub-contact 14, as shown in FIG. 2. The sub-contact 14 is a circuit terminal for detecting fitting. The sub-contact 14 is provided in the sub-housing 13 and is press-fitted into the sub-housing 13, for example. In the disclosure, the configuration in which the sub-housing 13 and the sub-contact 14 provided in the sub-housing 13 are combined is referred to as a sub-connector 13A. The sub-connector 13A is arranged to be slidable with the connector in the upper and lower direction in the main housing 11. In the disclosure, the sub-housing 13 and the sub-contact 14 each correspond to an example of the first sub-housing and the first sub-contact, respectively. In addition, a side of the first connector 10 in a state where the first connector 10 is fitted with the second connector 20 is referred as the upper side, and a side of the second connector 20 in such a state is referred as the lower side, in the description of embodiments for descriptive purposes.

The first connector 10 further includes a lever 15. The lever 15 is pivotably and slidably attached to the main housing 11, as shown in FIG. 1. For example, the lever 15 has two side surfaces connected by a handle and is attached so that both side surfaces straddle the main housing 11. The lever 15 can be pivoted and slid by an operation of a user. A pivot cam groove 151 and a slide guide groove 152 are formed in at least one of the both side surfaces of the lever 15 straddling the main housing 11. Further, a slide cam groove 153 for sliding the sub-housing 13 by a slide operation is formed in at least one of the both side surfaces of the lever 15 straddling the main housing 11.

The main housing 11 is provided with a boss 111 that is a central axis of pivot of the lever 15. As shown in FIG. 1, the boss 111 is inserted into the slide guide groove 152. The boss 111 serves not only as a central axis of pivot of the lever 15, but also as a guide for sliding the lever 15. Further, the sub-housing 13 is formed with a slide cam pin 131 that is inserted into the slide cam groove 153. In the disclosure, the lever 15 corresponds to an example of an operating member.

The first connector 10 may further include a lid 16, as shown in the embodiment of FIGS. 1 and 2. The main contact 12 and the sub-connector 13A are arranged in the main housing 11, and then, the main housing 11 is covered with the lid 16. When the main housing 11 is covered with the lid 16, the first connector 10 becomes a connector having a fitting opening that is open on one side.

Figure 3:
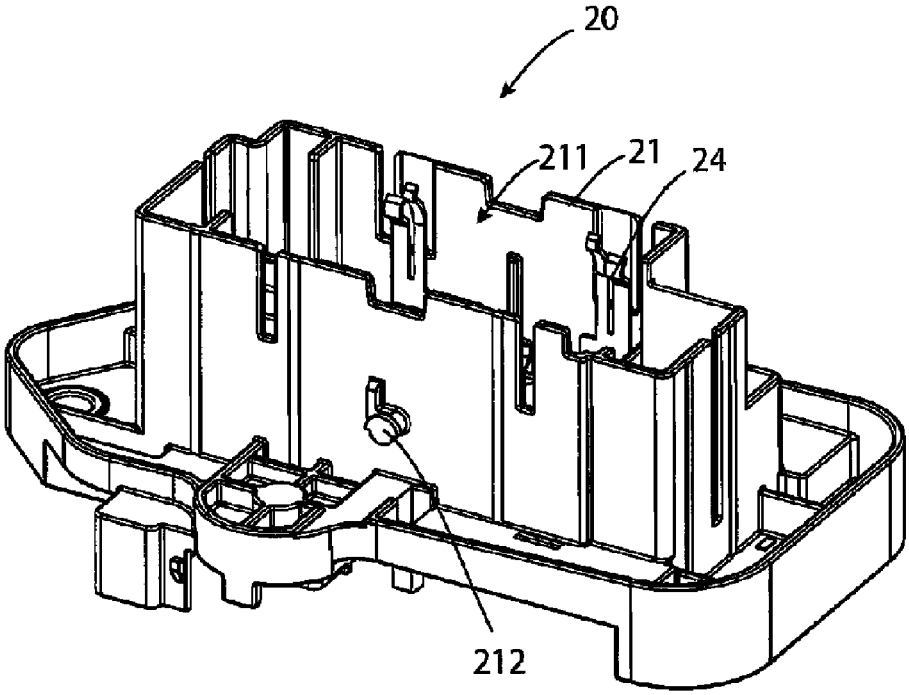
FIG. 3 is a perspective view of a second connector.
Figure 4:
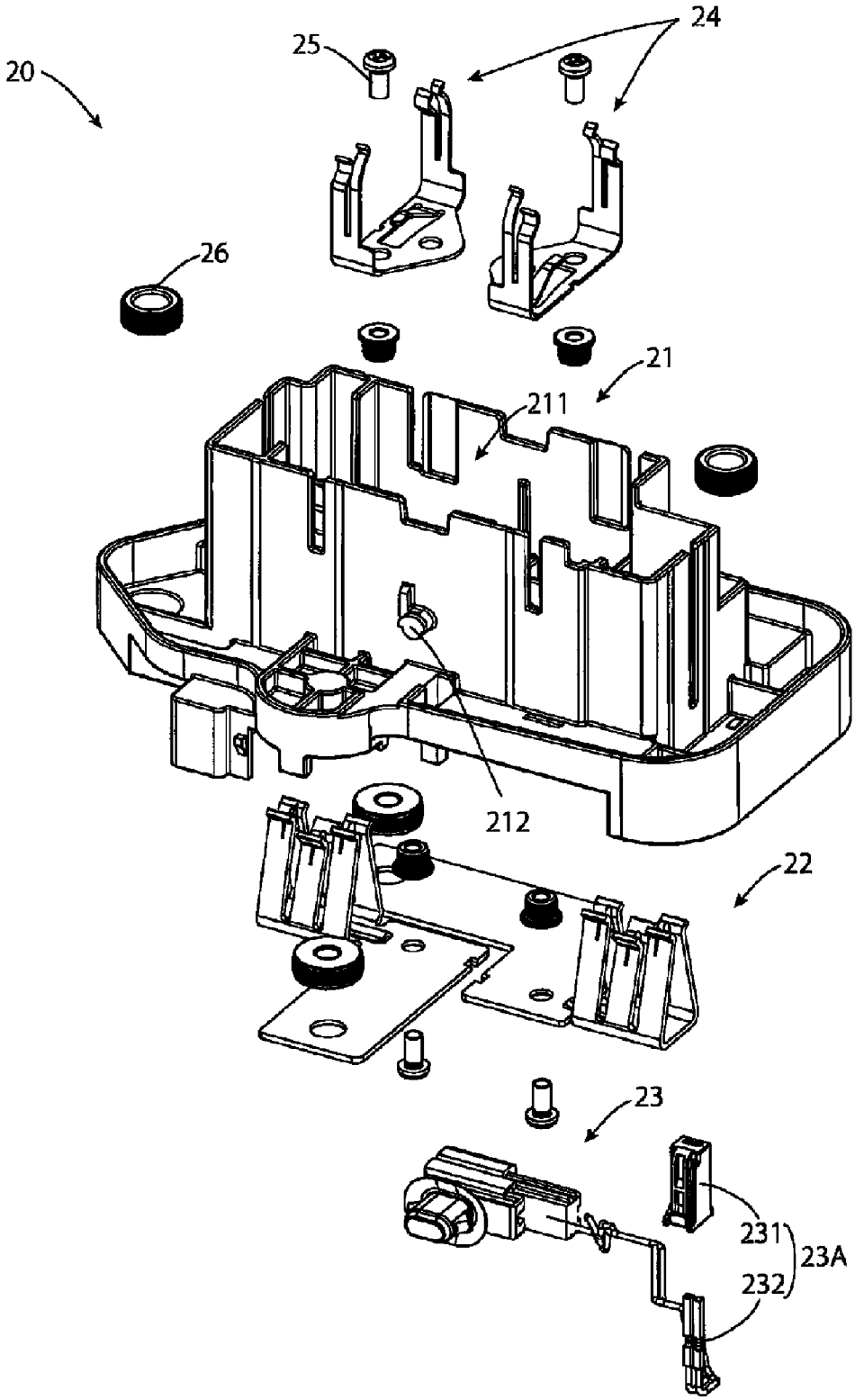
FIG. 4 is an exploded perspective view of the second connector.

The second connector 20, shown in FIGS. 3 and 4, corresponds to an example of a mating connector mentioned in the connector of the disclosure and an example of the second connector constituting the connector assembly of the disclosure.

The second connector 20 includes a housing 21, as shown in FIGS. 3 and 4. The housing 21 has a fitting opening facing the fitting opening of the first connector 10 and for fitting with the first connector 10. The fitted state of the first connector 10 and the second connector 20 are described in greater detail below with reference to FIGS. 4A to 11B. A cam pin 212 that is inserted into the pivot cam groove 151 of the lever 15 provided in the first connector 10 protrudes on the side surface of the housing 21. In the disclosure, the housing 21 corresponds to an example of the second housing.

The second connector 20 has a main contact 22, as shown in FIG. 4. The main contact 22 is a circuit terminal that is electrically connected to the main contact 12 of the first connector 10 to pass large current, also referred to as a main power conduction, therethrough. In the disclosure, the main contact 22 corresponds to an example of the second main contact.

As shown in FIG. 4, the second connector 20 is provided with an interlock wire harness 23. The interlock wire harness 23 includes a sub-connector 23A that includes a sub-housing 231 and a sub-contact 232 provided inside the sub-housing 231. In the disclosure, the sub-contact 232 provided inside the sub-housing 231 constituting the sub-connector 23A corresponds to an example of the second sub-contact. The sub-connector 23A is a connector for detecting fitting, and a fitting/separating signal is transmitted to a controller via the interlock wire harness 23.

The second connector 20 includes a fuse holding spring 24 shown in FIGS. 3 and 4. The fuse holding spring 24 is a part for holding the fuse 121 of the main contact 12 of the first connector 10 when the second connector 20 is fitted with the first connector 10. In FIG. 4, screws 25 and collars 26 for screwing members to assembly the second connector 20 are further shown.

Figure 5A:
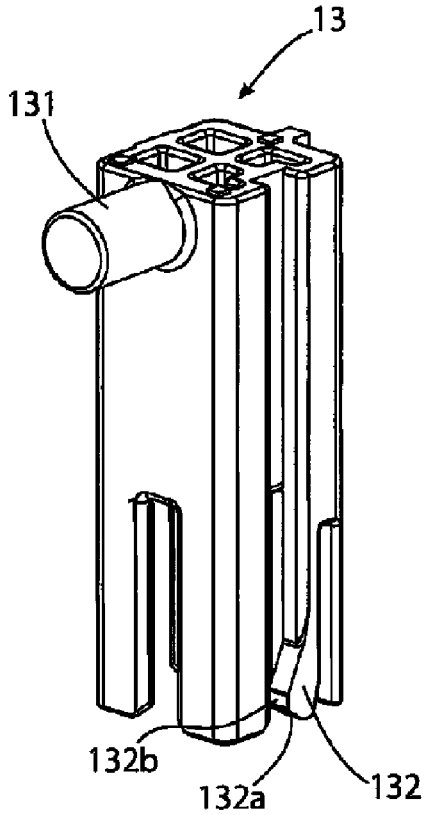
FIG. 5A is a perspective view of a sub-housing of the first connector.
Figure 5B:
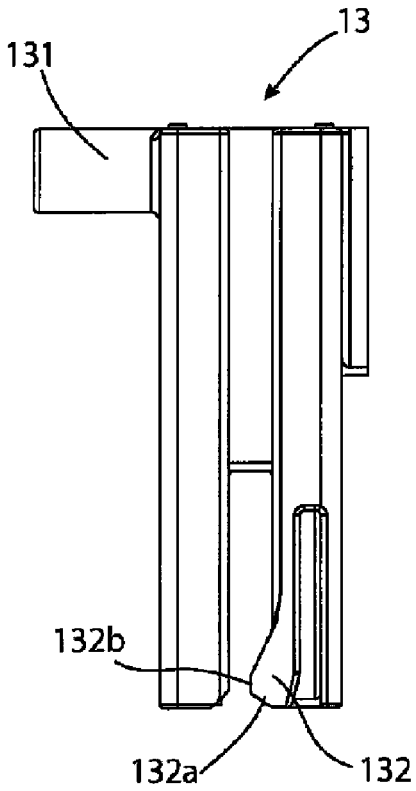
FIG. 5B is a side view of the sub-housing of FIG. 5A.

FIGS. 5A and 5B are an enlarged perspective view and an enlarged side view of the sub-housing 13 provided in the first connector 10. The sub-housing 13 is provided with an erroneous fitting prevention part 132. The erroneous fitting prevention part 132 extends in a cantilever shape in a fitting direction in which the first connector 10 and the second connector 20 are fitted. The fitting direction may be the upper-lower direction. The erroneous fitting prevention part 132 has a slanting surface 132*a* formed at a tip thereof. Further, a convex portion 132*b* protruding laterally with respect to the upper-lower direction is formed on the erroneous fitting prevention part 132. The operation of the erroneous fitting prevention part 132 will be described later. The erroneous fitting prevention part 132 corresponds to an example of the erroneous fitting prevention part mentioned in the connector of the disclosure and an example of the first erroneous fitting prevention part mentioned in the connector assembly of the disclosure. Further, the slanting surface 132*a* corresponds to an example of the tip portion mentioned in the disclosure.

Figure 6A:
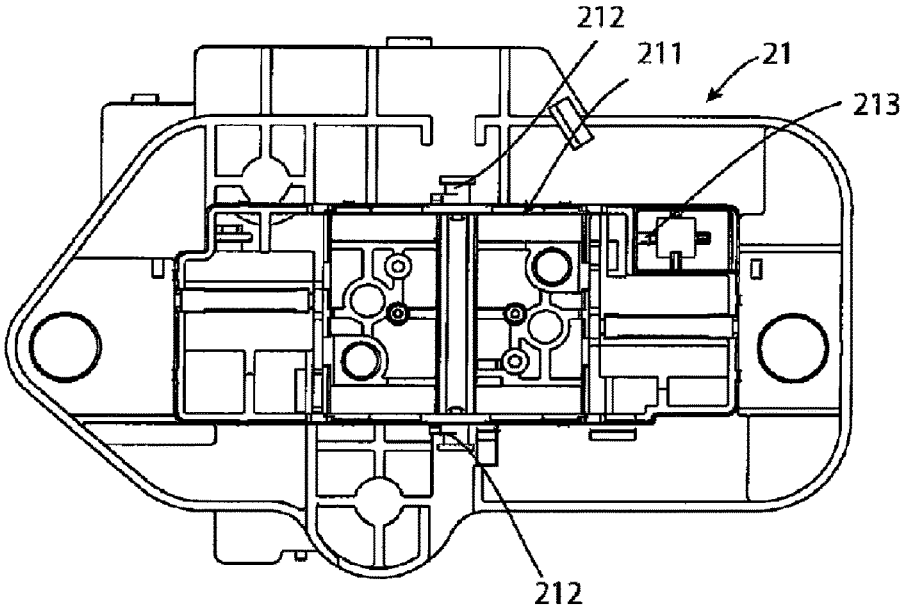
FIG. 6A is a plan view of a housing of the second connector.
Figure 6B:
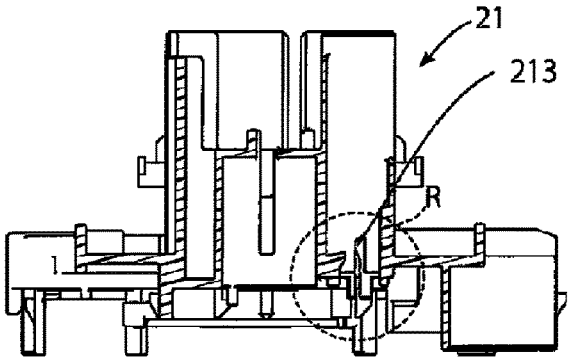
FIG. 6B is a sectional side view of the housing of FIG. 6A.
Figure 6C:
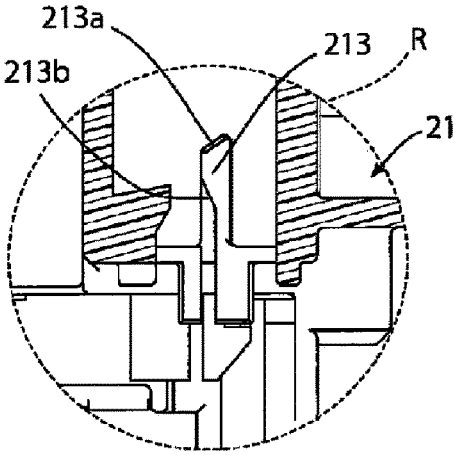
FIG. 6C is an enlarged view of a portion R of FIG. 6B.

FIGS. 6A to 6C are a plan view, a sectional view, and an enlarged view of the circle portion R in the sectional view of the housing 21 constituting the second connector 20. An erroneous fitting prevention protrusion 213 protruding upward is provided on the housing 21. The slanting surface 132*a* at the tip of the erroneous fitting prevention part 132 of the sub-housing 13 shown in FIG. 5 abuts against a top surface 213*a* of the erroneous fitting prevention protrusion 213 formed into a slanting surface, so that the sub-contact 14 of the first connector 10 and the sub-contact 232 of the second connector 20 are prevented from being connected to each other. Further, a concave portion 213*b* is formed on a side surface of the erroneous fitting prevention protrusion 213. The erroneous fitting prevention protrusion 213 corresponds to an example of the second erroneous fitting prevention part mentioned in the disclosure.

Next, the movement of both connectors at the time of fitting will be described. In each of the drawings after FIG. 7A described below, the sub-contact 14 and the sub-connector 23A of the second connector 20 are not shown in order to clearly show the present embodiment. The sub-housing 13 is shown because it is necessary for the explanation of the present embodiment.

Figure 7A:
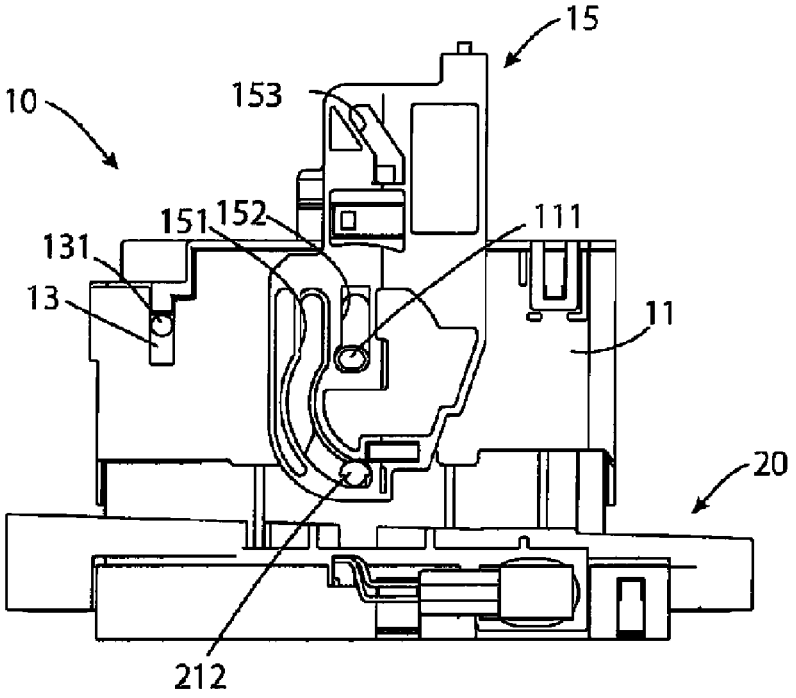
FIG. 7A is a side view of an initial state of fitting of the first connector on the second connector.
Figure 7B:
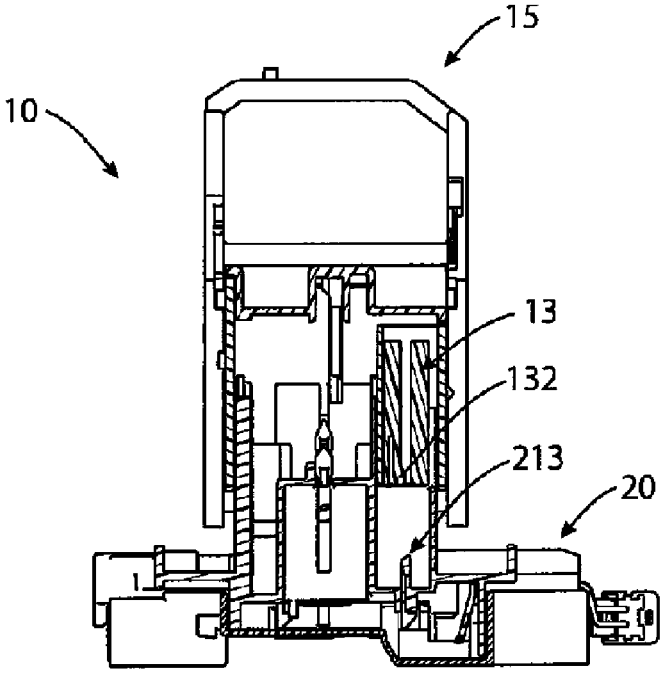
FIG. 7B is a sectional side view of the initial state of FIG. 7A.

FIGS. 7A and 7B are a side view and a sectional view showing an initial state of fitting in which the first connector 10 is stacked on the second connector 20. However, in FIG. 7A, the side surface opposite to the side surface shown in FIG. 1 appears. Here, the lever 15 is still in an upright state and is in a pivot start position. Further, as shown in FIG. 7A, the cam pin 212 of the housing 21 of the second connector 20 is inserted into the pivot cam groove 151. Further, as shown in FIG. 7B, the sub-housing 13 is located directly above the erroneous fitting prevention protrusion 213 provided on the housing 21 of the second connector 20. At this time, the sub-contact 14 of the first connector 10 is not connected with the sub-contact 232 of the second connector 20. The sub-housing 13 is in a regular initial position before fitting. The correlation state between the first connector 10 and the second connector 20 shown in FIGS. 7A and 7B is referred to as an initial state of regular fitting.

Figure 8A:
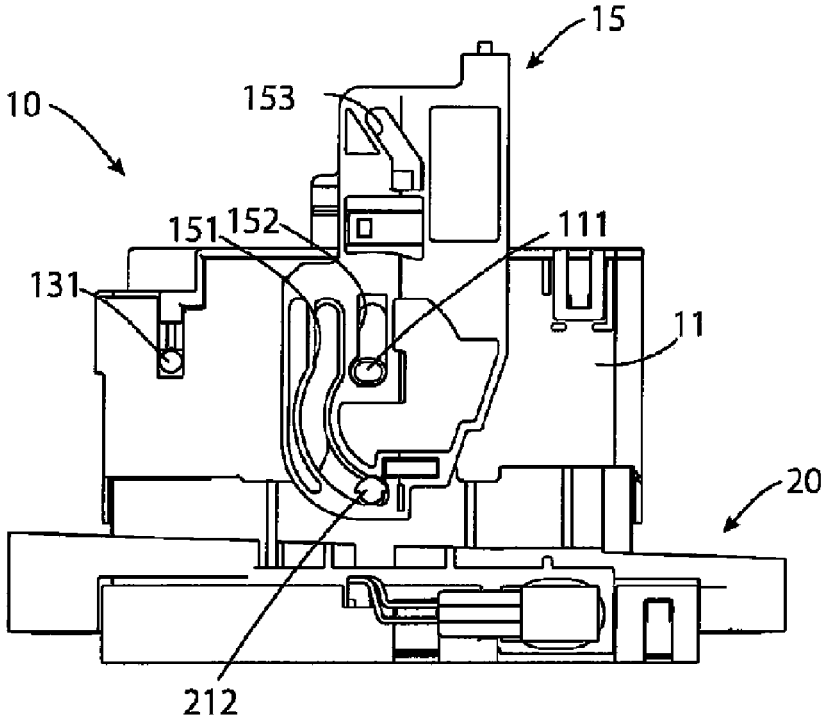
FIG. 8A is a side view of an initial state of fitting when the sub-housing is in a misaligned state.
Figure 8B:
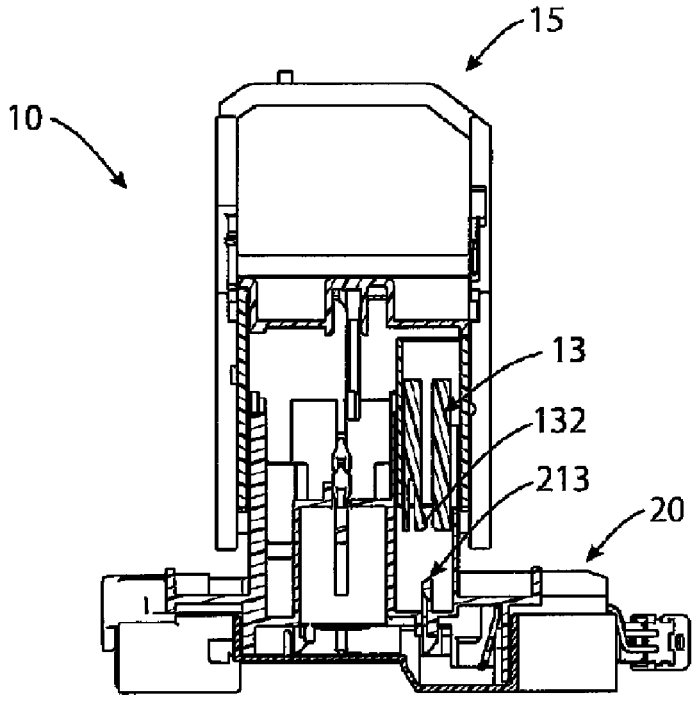
FIG. 8B is a sectional side view of the initial state of FIG. 8A.

FIGS. 8A and 8B are a side view and a sectional view showing an initial state of non-regular fitting of the first connector 10 and the second connector 20 when the sub-housing 13 is on a position (non-regular initial position) deviated from the regular initial position.

As can be seen by comparing FIG. 7A and FIG. 8A, in FIG. 8A, the slide cam pin 131 provided in the sub-housing 13 is moved downward as compared with FIG. 7A. Further, as can be seen by comparing FIG. 7B and FIG. 8B, the sub-connector 13 is moved downward. However, only the sub-housing 13 is moved downward, and the parts of the first connector 10 other than the sub-connector 13 are located at the same height position in FIGS. 7A and 7B, and FIGS. 8A and 8B. For example, the lever 15 is in the pivot start position.

The sub-housing 13 is supported on the main housing 11 to be slidable in the upper and lower direction. Therefore, due to some mistake or careless force, the sub housing 13, which should be normally arranged at the height shown in FIGS. 7A and 7B, may be moved downward to the position shown in FIGS. 8A and 8B. In the case of the present embodiment, even when the sub-housing 13 is moved to the non-regular initial position in the initial state of non-regular fitting, there is a structure preventing an occurrence of an accident in which the sub-contacts 14, 232 are connected to each other prior to the sliding operation (hereinafter, refer to FIGS. 10A to 11B and the corresponding description) of the lever 15 (the first connector 10 and the second connector 20 are erroneously fitted). Further, the connection of the sub-contacts 14, 232 to each other is always performed by the sliding operation of the lever 15.

Hereinafter, the movement of each member when the user tries to fit the first connector 10 and the second connector 20 in a state where the sub-housing 13 is moved downward to the non-regular initial position shown in FIGS. 8A and 8B will be described.

Figure 9A:
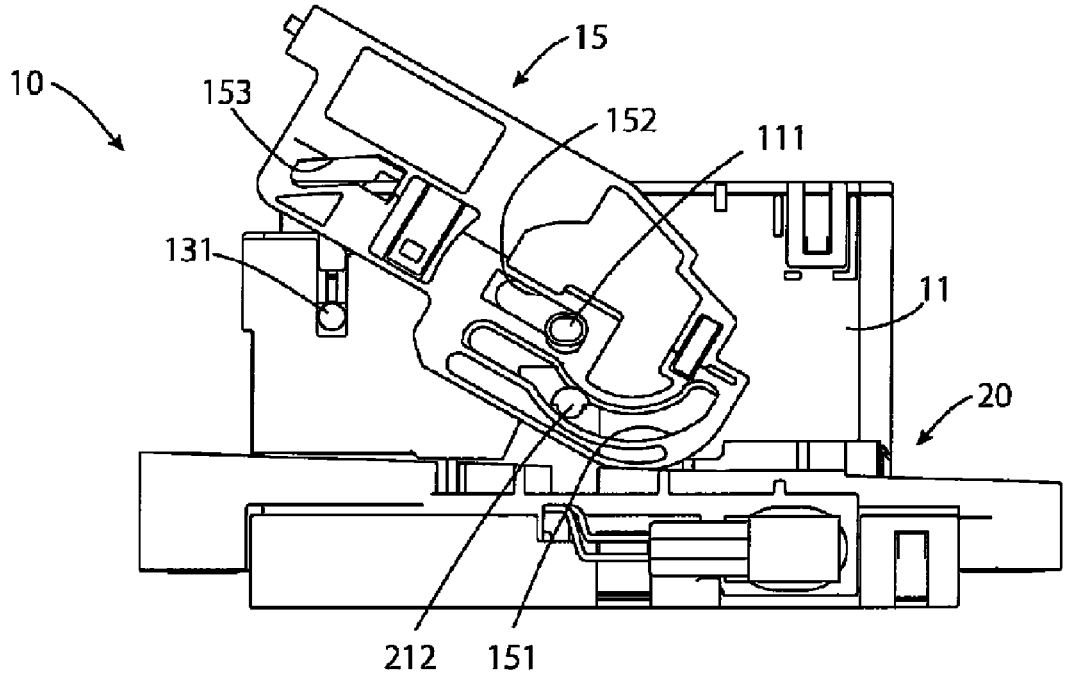
FIG. 9A is a side view of a state during fitting of the first connector and the second connector.
Figure 9B:
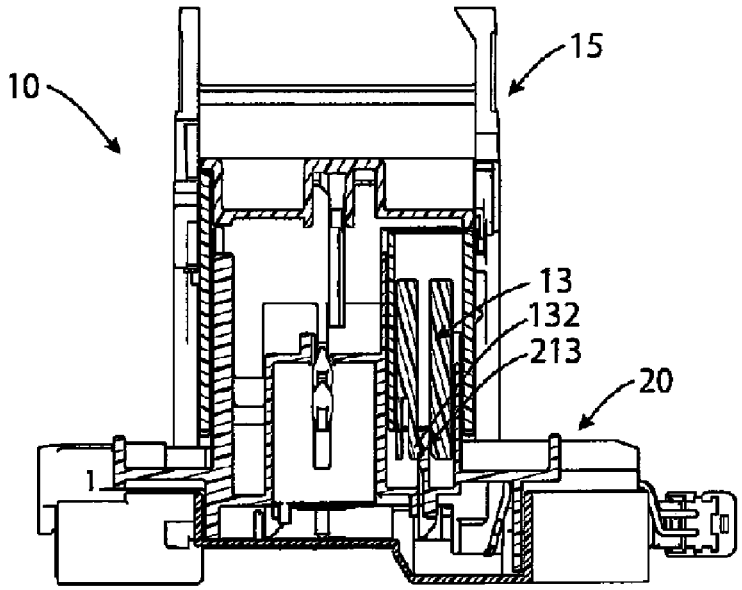
FIG. 9B is a sectional side view of the state of FIG. 9A.

FIGS. 9A and 9B are a side view and a sectional view showing a state during fitting. In FIGS. 9A and 9B, the lever 15 is pivoted halfway from a first posture toward a second posture. At this time, the cam pin 212 inserted into the pivot cam groove 151 is pushed downward according to the shape of the pivot cam groove 151, and the main housing 11 of the first connector 10 moves closer to the second connector 20 toward a fitting completed position (that is, moves downward in the drawing). The main contact 12 (see FIG. 1) provided in the main housing 11 also moves downward together with the main housing 11. Furthermore, the sub-housing 13 also moves downward together with the main housing 11. Comparing FIG. 8A and FIG. 9A, the relative position of the slide cam pin 131 of the sub-housing 13 to the main housing 11 is the same. From this, it can be seen that the sub-housing 13 is moving downward together with the main housing 11.

When the lever 15 is pivoted from the pivot start position, or a first posture, to an angle shown in FIGS. 9A and 9B, as shown in FIG. 9B, the slanting surface 132*a* (see FIG. 5) at the tip of the erroneous fitting prevention part 132 of the sub-housing 13 abuts against the top surface 213*a* of the erroneous fitting prevention protrusion 213 (see FIG. 6C) in the state of incomplete fitting of the first connector 10 with the second connector 20.

Figure 10A:
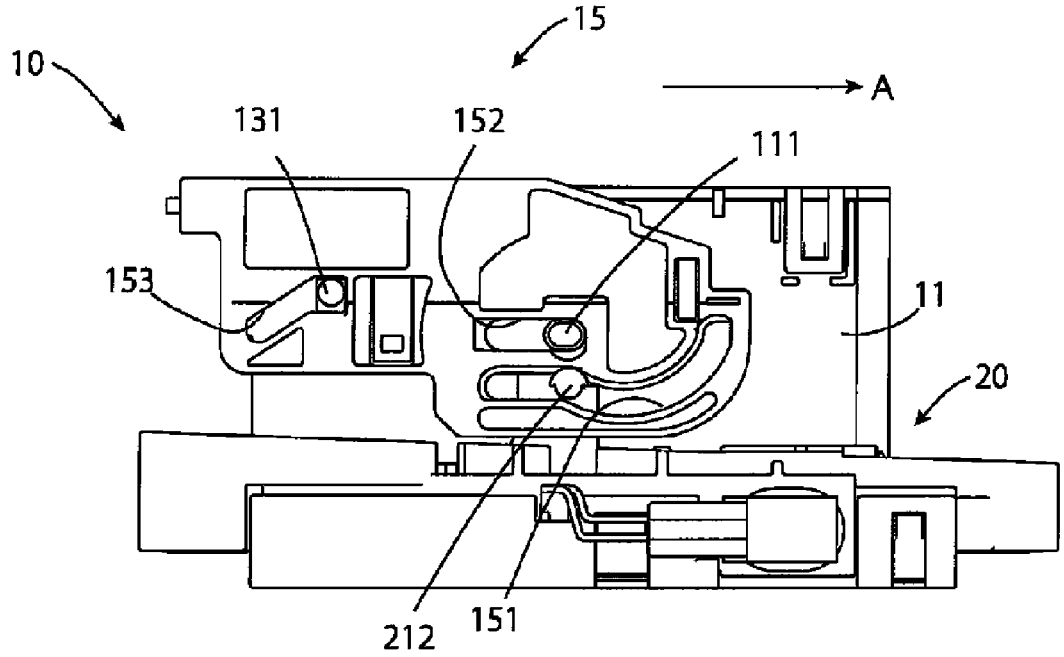
FIG. 10A is a side view of a state in which a lever is pivoted to a final pivot position.
Figure 10B:
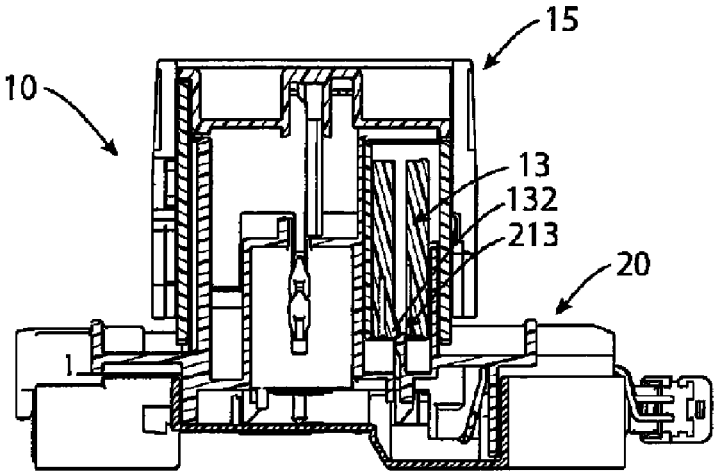
FIG. 10B is a sectional side view of the state of FIG. 10A.

FIGS. 10A and 10B are a side view and a sectional view showing a state in which the lever 15 is pivoted to a pivot end position, or a second posture. Comparing FIGS. 10A and 10B and FIGS. 9A and 9B, the main housing 11 is in a position further lowered toward the second connector 20 according to the shape of the pivot cam groove 151. However, as shown in FIG. 10B, the erroneous fitting prevention part 132 is in contact with the erroneous fitting prevention protrusion 213, and the sub-housing 13 remains at the same height position as FIG. 9B. If the erroneous fitting prevention part 132 and the erroneous fitting prevention protrusion 213 are not formed, the sub-housing 13 moves further downward together with the main housing 11 when moving from the state of FIG. 9B to the state of FIG. 10B. That is, it may be erroneously detected that the sub-contacts 14, 232 are connected to each other by the lever 15 being regularly slid. In this position, the first main contact 12 electrically connects with the second main contact 22 for a main power conduction.

In the case of the present embodiment, the sub-housing 13 remains at the height position where the erroneous fitting prevention part 132 is in contact with the erroneous fitting prevention protrusion 213, so that there is no risk of erroneous detection. In this way, the sub-housing 13 remains at the height position of the sub-housing 13 until the lever 15 moves from the angle shown in FIGS. 9A and 9B to the final angle shown in FIGS. 10A and 10B. Therefore, when the lever 15 is pivoted to the final angle shown in FIGS. 10A and 10B, the sub-housing 13 is in the same state as when it is in the regular initial position shown in FIGS. 7A and 7B in the fitting initial state. Further, when the lever 15 is pivoted to the final angle shown in FIGS. 10A and 10B, the slide cam pin 131 is inserted into the slide cam groove 153.

Thereafter, the lever 15 is slid in a direction different from the fitting direction of both connectors as in the direction of the arrow A shown in FIG. 10A. For example, the lever 15 is slid in a direction intersecting the fitting direction. During this sliding operation, the cam pin 212 inserted into the pivot cam groove 151 moves through a horizontally extending portion of the pivot cam groove 151 to be substantially horizontally with respect to the lever 15. Further, the slide guide groove 152 also extends horizontally, and the boss 111 inserted into the slide guide groove 152 also moves substantially horizontally with respect to the lever 15. That is, the height of the main housing 11 does not change substantially depending on the sidling of the lever 15 in the direction of the arrow A, and the main housing 11 remains at about the same height as before the sliding.

On the other hand, the slide cam groove 153 extends downward diagonally, as shown in FIG. 10A. The slide cam pin 131 of the sub-housing 13 is inserted into the slide cam groove 153. Therefore, when the lever 15 is slid in the direction of the arrow A, the sub-housing 13 is further moved downward.

Figure 11A:
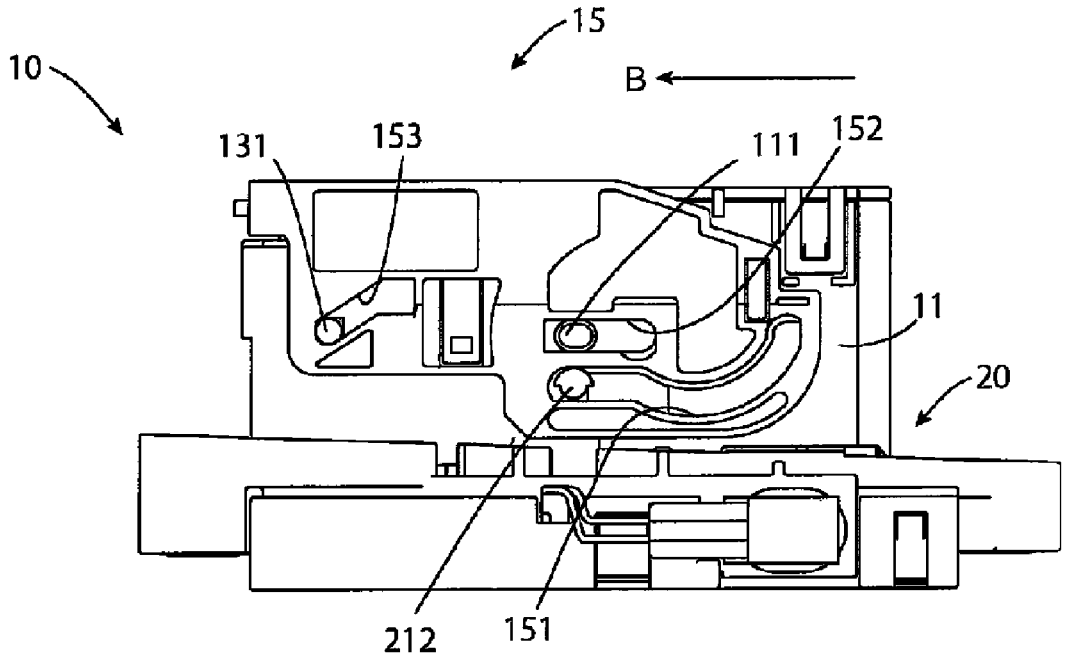
FIG. 11A is a side view of a state after the lever is slid.
Figure 11B:
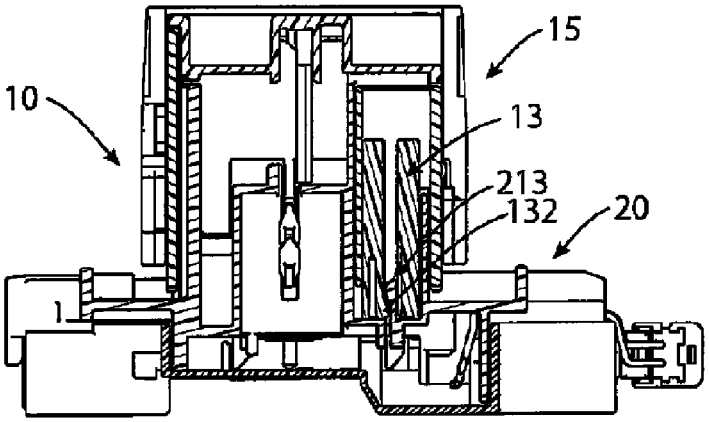
FIG. 11B is a sectional side view of the state of FIG. 11A.

FIGS. 11A and 11B are a side view and a sectional view showing a state after the lever 15 is slid in the direction of the arrow A. As shown in FIG. 11B, the sub-housing 13 is in a position further lowered as compared with FIG. 10B. In this lowered position of the sub-housing 13, the first sub-contact 14 electrically contacts the second sub-contact 232. The electrical connection of the first sub-contact 14 with the second sub-contact 232 detects a fitting of the first connector 10 with the second connector 20.

When the lever 15 is slid in the direction of the arrow A from the state shown in FIGS. 10A and 10B, the erroneous fitting prevention part 132 of the sub-housing 13 temporarily bends in a direction intersecting the fitting direction, and the contact with the erroneous fitting prevention protrusion 213 is released to permit the sub-housing 13 to move downward. At this time, the erroneous fitting prevention part 132 may bend laterally. Further, the lever 15 is further slid in the direction of the arrow A to move the sub-housing 13 downward and electrically connect the first sub-contact 14 with the second sub-contact 232, and finally, the convex portion 132*b* (see FIG. 5) of the erroneous fitting prevention part 132 of the sub-housing 13 is inserted into the concave portion 213*b* (see FIG. 6) on the side surface of the erroneous fitting prevention protrusion 213.

As described above, because the present embodiment includes the erroneous fitting prevention part 132 and the erroneous fitting prevention protrusion 213, the erroneous fitting is prevented. Further, in the present embodiment, the lever 15 is correctly operated regardless of the height position of the sub-housing 13 in the fitting initial state.

When releasing the fitted state of the connector, a reverse operation with respect to the above-described fitting operation is performed. That is, first, the lever 15 is slid in the direction of the arrow B shown in FIG. 11A. Then, only the sub-housing 13 is lifted to the position shown in FIG. 10. At this stage, it is detected that the fitting of the sub-connectors 13A, 23A to each other is released and the separation operation is performed. In order to cut off large current passing through the main contacts 12, 22, although it is a short period of time, a certain period time is required from the detection that the separation operation is performed. In the present embodiment, the connection of the main contacts 12, 22 is released by the pivot operation of the lever 15 after the slide operation. Even when the pivot operation is continuously performed after the slide operation, a certain time for cutting off large current is sufficiently secured.

When the lever 15 is slid in the direction of the arrow B, and then, the lever 15 is pivoted from the posture shown in FIG. 11A toward the posture shown in FIG. 7A, the first connector 10 can be separated from the second connector 20.

As described above, the connector and the connector assembly of the disclosure include the erroneous fitting prevention structure. Therefore, according to the disclosure, the sub-contact is prevented from being connected before the slide operation. Further, according to the disclosure, it is possible to reliably perform the pivot operation and the subsequent slide operation.

What is claimed is:

1. A connector configured to be fitted with a mating connector, comprising:

a main housing;

a first main contact provided in the main housing;

a sub-housing supported on the main housing to be slidable in a fitting direction in which the connector is fitted with the mating connector, the sub-housing having an erroneous fitting prevention part, the erroneous fitting prevention part extends in a cantilever shape in the fitting direction;

a first sub-contact provided in the sub-housing; and an operating member pivotably and slidably supported on the main housing, the main housing moves closer to the mating connector when the operating member is pivoted from a first posture to a second posture, the first main contact electrically connects with a second main contact of the mating connector for a main power conduction when the operating member reaches the second posture, the sub-housing moves in the fitting direction and the first sub-contact electrically contacts a second sub-contact of the mating connector for detecting a fitting of the connector with the mating connector when the operating member slides from the second posture in a direction different from the fitting direction, the erroneous fitting prevention part has a tip portion at an end of the cantilever shape that abuts against the mating connector to prevent the first sub-contact from coming into contact with the second sub-contact when the first sub-contact slides in the fitting direction with respect to the main housing in a state of incomplete fitting of the connector with the mating connector, the erroneous fitting prevention part is released from abutting against the mating connector by a slide of the operating member from the second posture to electrically connect the first sub-contact with the second sub-contact.

2. The connector of claim 1, wherein the erroneous fitting prevention part is pushed in the fitting direction by the slide of the operating member from the second posture.

3. The connector of claim 2, wherein the erroneous fitting prevention part is bent in a direction intersecting the fitting direction, so that an abutting of the tip portion with the housing of the mating connector is released when the operating member slides from the second posture.

4. A connector assembly, comprising:

a first connector including:

a main housing;

a first main contact provided in the main housing;

a first sub-housing supported on the main housing to be slidable in a fitting direction in which the first connector is connected with a second connector, the first sub-housing has a first erroneous fitting prevention part, the first erroneous fitting prevention part extends in a cantilever shape in the fitting direction;

a first sub-contact provided in the first sub-housing; and an operating member pivotably and slidably supported on the main housing; and the second connector fitted with the first connector, the second connector including:

a second housing having a second erroneous fitting prevention part;

a second main contact provided in the second housing; and a second sub-contact, the main housing moves closer to the second connector when the operating member is pivoted from a first posture to a second posture, the first main contact electrically contacts the second main contact for a main power conduction when the operating member reaches the second posture, the first sub-housing moves in the fitting direction with respect to the main housing and the first sub-contact electrically contacts the second sub-contact for detecting a fitting of the first connector with the second connector when the operating member slides from the second posture in a direction different from the fitting direction, the first erroneous fitting prevention part has a tip portion at an end of the cantilever shape that abuts against the second erroneous fitting prevention part to prevent the first sub-contact from coming into contact with the second sub-contact when the first sub-contact slides in the fitting direction with respect to the main housing in a state of incomplete fitting before the first connector is completely fitted with the second connector, the first erroneous fitting prevention part is released from abutment against the second erroneous fitting prevention part by a slide of the operating member from the second posture to electrically connect the first sub-contact with the second sub-contact.

5. A connector configured to be fitted with a mating connector, comprising:

a main housing;

a sub-housing supported on the main housing to be slidable in a fitting direction with respect to the main housing in which the connector is fitted with the mating connector, the sub-housing having an erroneous fitting prevention part, the erroneous fitting prevention part extends in a cantilever shape in the fitting direction; and an operating member pivotably and slidably supported on the main housing, the main housing moves closer to the mating connector when the operating member is pivoted from a first posture to a second posture, the sub-housing moves in the fitting direction when the operating member slides from the second posture in a direction different from the fitting direction, the erroneous fitting prevention part has a tip portion at an end of the cantilever shape that abuts against the mating connector in a state of incomplete fitting of the connector with the mating connector.

6. The connector of claim 5, wherein the sub-housing remains at a position in the fitting direction during a portion of the pivoting of the operating member from the first posture to the second posture with the erroneous fitting prevention part abutting against the mating connector.

7. The connector of claim 5, wherein the erroneous fitting prevention part is released from abutting against the mating connector by a slide of the operating member from the second posture.

8. The connector of claim 7, further comprising a first sub-contact provided in the sub-housing, the first sub-contact electrically contacts a second sub-contact of the mating connector for detecting a fitting of the connector with the mating connector when the operating member slides from the second posture in the direction different from the fitting direction.

9. The connector of claim 8, wherein abutment of the erroneous fitting prevention part against the mating connector prevents the first sub-contact from coming into contact with the second sub-contact in the state of incomplete fitting.

10. The connector of claim 9, wherein release of the abutment of the erroneous fitting prevention part against the mating connector permits movement of the sub-housing in the fitting direction that electrically connects the first sub-contact with the second sub-contact.

11. The connector of claim 7, wherein the erroneous fitting prevention part is pushed in the fitting direction by the slide of the operating member from the second posture.

12. The connector of claim 11, wherein the erroneous fitting prevention part is bent in a direction intersecting the fitting direction to release the abutment of the erroneous fitting prevention part with the mating connector when the operating member slides from the second posture.

13. The connector of claim 11, wherein the operating member has a slide cam groove engaging a slide cam pin of the sub-housing to move the sub-housing in the fitting direction by sliding the operating member from the second posture.

14. The connector of claim 5, further comprising a first main contact provided in the main housing, the first main contact electrically connects with a second main contact of the mating connector for a main power conduction when the operating member reaches the second posture.

15. The connector of claim 5, wherein the operating member has a pivot cam groove, a cam pin of the mating connector is inserted in the pivot cam groove and moves in the pivot cam groove during pivoting of the operating member.

16. The connector of claim 5, wherein the main housing has a boss disposed in a slide guide groove of the operating member, the operating member pivots about the boss, the boss moves in the slide guide groove when the operating member slides from the second posture.

* * * * *